US007152714B2

(12) United States Patent
Christy et al.

(10) Patent No.: US 7,152,714 B2
(45) Date of Patent: Dec. 26, 2006

(54) ELEVATOR CAR SEPARATION BASED ON RESPONSE TIME

(75) Inventors: Theresa M. Christy, West Hartford, CT (US); Mark A. Ross, Shelton, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/552,266

(22) PCT Filed: May 19, 2003

(86) PCT No.: PCT/US03/16087

§ 371 (c)(1),
(2), (4) Date: Oct. 4, 2005

(87) PCT Pub. No.: WO2004/103877

PCT Pub. Date: Dec. 2, 2004

(65) Prior Publication Data

US 2006/0237264 A1 Oct. 26, 2006

(51) Int. Cl.
*B66B 1/18* (2006.01)

(52) U.S. Cl. ..... 187/382; 187/387; 187/247

(58) Field of Classification Search ..... 187/247, 187/248, 380–389; 706/910, 13
See application file for complete search history.

(56) References Cited

U.S. PATENT DOCUMENTS 4,760,896 A 8/1988 Yamaguchi
5,022,498 A * 6/1991 Sasaki et al. ..... 187/387
5,248,860 A * 9/1993 Sirag, Jr. ..... 187/383
5,347,093 A * 9/1994 Kezer et al. ..... 187/382
5,447,212 A * 9/1995 Powell ..... 187/382
5,672,853 A 9/1997 Whitehall et al.
5,767,460 A * 6/1998 Thangavelu ..... 187/382
5,786,551 A * 7/1998 Thangavelu ..... 187/386
5,883,343 A 3/1999 MacDonald et al.
6,237,721 B1 * 5/2001 Siikonen ..... 187/382
6,394,232 B1 5/2002 Iwata et al.
6,401,874 B1 * 6/2002 Siikonen ..... 187/382
6,672,431 B1 * 1/2004 Brand et al. ..... 187/382
2001/0002636 A1 * 6/2001 Siikonen ..... 187/382
2004/0262089 A1 * 12/2004 Nikovski et al. ..... 187/282

OTHER PUBLICATIONS

PCT International Search Report for PCT/US03/16087, dated Sep. 22, 2003.
International Preliminary Examination Report for PCT/US03/16087, dated Feb. 2, 2004.

* cited by examiner

*Primary Examiner*—Jonathan Salata

(57) ABSTRACT

The time required for each car to reach each up hall call and each down hall call is calculated (30, 33). These times are then arranged in categories and the number of landings in each category is identified. From fuzzy sets (FIGS. 7–10), the count of landings in each category determines a fuzzy set membership in a fuzzy category, such as FEW, SOME, MANY. The fuzzy membership of all non-zero memberships are then ANDed together (by multiplication). A relationship value is then determined (FIG. 11) by a metric with as many dimensions as there are categories, each dimension having as many parts as there are fuzzy categories in the fuzzy sets. The membership combination (the fuzzy summation) is then multiplied by a relationship value determined from the multi-dimensional metric to provide a corresponding separation metric of the invention.

2 Claims, 7 Drawing Sheets

FIG.3 CAR A

| LOCATION | EXISTING DEMAND | TIME AT FLOOR | CUMULATIVE TIME |
|---|---|---|---|
| 4 DN | NONE | 0(CAR AT FLOOR) | 0 |
| 3 DN | CC | 1 SEC.+10 SEC. | 11 SEC. |
| 2 DN | CC,HC | 1 SEC.+11 SEC. | 23 SEC. |
| LOBBY | HC | 1 SEC.+11 SEC. | 35 SEC. |
| 2 UP | HC | 1 SEC.+11 SEC. | 47 SEC. |
| 3 UP | NONE | 1 SEC. | 48 SEC. |
| 4 UP | NONE | 1 SEC. | 49 SEC. |
| 5 UP | NONE | 1 SEC. | 50 SEC. |
| 6 UP | NONE | 1 SEC. | 51 SEC. |
| 7 UP | NONE | 1 SEC. | 52 SEC. |
| 8 UP | NONE | 1 SEC. | 53 SEC. |
| 9 UP | NONE | 1 SEC. | 54 SEC. |
| 10 DN | NONE | 1 SEC. | 55 SEC. |
| 9 DN | NONE | 1 SEC. | 56 SEC. |
| 8 DN | NONE | 1 SEC. | 57 SEC. |
| 7 DN | NONE | 1 SEC. | 58 SEC. |
| 6 DN | NONE | 1 SEC. | 59 SEC. |
| 5 DN | NONE | 1 SEC. | 60 SEC. |

FIG.4 CAR B

| LOCATION | EXISTING DEMAND | TIME AT FLOOR | CUMULATIVE TIME |
|---|---|---|---|
| 3 UP | NONE | 0(CAR AT FLOOR) | 0 |
| 4 UP | CC | 1 SEC.+10 SEC. | 11 SEC. |
| 5 UP | CC | 1 SEC.+10 SEC. | 22 SEC. |
| 6 UP | HC | 1 SEC.+11 SEC. | 34 SEC. |
| 7 UP | CC | 1 SEC.+10 SEC. | 45 SEC. |
| 8 UP | NONE | 1 SEC. | 46 SEC. |
| 9 UP | NONE | 1 SEC. | 47 SEC. |
| 10 DN | NONE | 1 SEC. | 48 SEC. |
| 9 DN | NONE | 1 SEC. | 49 SEC. |
| 8 DN | HC | 1 SEC.+11 SEC. | 61 SEC. |
| 7 DN | NONE | 1 SEC. | 62 SEC. |
| 6 DN | NONE | 1 SEC. | 63 SEC. |
| 5 DN | NONE | 1 SEC. | 64 SEC. |
| 4 DN | NONE | 1 SEC. | 65 SEC. |
| 3 DN | NONE | 1 SEC. | 66 SEC. |
| 2 DN | NONE | 1 SEC. | 67 SEC. |
| LOBBY | NONE | 1 SEC. | 68 SEC. |
| 2 UP | NONE | 1 SEC. | 69 SEC. |

FIG.5

| LOCATION | CAR A | CAR B | MINIMUM | CATEGORY |
|---|---|---|---|---|
| LOBY | 35 | 68 | 35 | 2 |
| 2 UP | 47 | 69 | 47 | 3 |
| 3 UP | 48 | 0 | 0 | 1 |
| 4 UP | 49 | 11 | 11 | 1 |
| 5 UP | 50 | 22 | 22 | 1 |
| 6. UP | 51 | 34 | 34 | 2 |
| 7 UP | 52 | 45 | 45 | 3 |
| 8 UP | 53 | 46 | 46 | 3 |
| 9 UP | 54 | 47 | 47 | 3 |
| 10 DN | 55 | 48 | 48 | 3 |
| 9 DN | 56 | 49 | 49 | 3 |
| 8 DN | 57 | 61 | 57 | 3 |
| 7 DN | 58 | 62 | 58 | 3 |
| 6 DN | 59 | 63 | 59 | 3 |
| 5 DN | 60 | 64 | 60 | 4 |
| 4 DN | 0 | 65 | 0 | 1 |
| 3 DN | 11 | 66 | 11 | 1 |
| 2 DN | 23 | 67 | 23 | 1 |

FIG.6

| ← | CATEGORY | COUNT |
|---|---|---|
| 1 | 0–29 SECONDS | 6 |
| 2 | 30–44 SECONDS | 2 |
| 3 | 45–59 SECONDS | 9 |
| 4 | 60–89 SECONDS | 1 |
| 5 | OVER 90 SECONDS | 0 |

ELEVATOR CAR SEPARATION BASED ON RESPONSE TIME

TECHNICAL FIELD

This invention relates to dispatching elevator cars in a manner which takes into account bunching of the cars, as determined by response time to various calls.

BACKGROUND ART

Typical dispatching algorithms for multicar elevator systems in buildings having more than 10 or 20 floors evaluate many factors to determine which car should be assigned to answer a newly entered hall call. The principle is to select a car that will provide satisfactory service to the new hall call without negatively impacting other passengers in the elevator system. Two major considerations in assignment logic is the remaining response time (RRT), which is the predicted amount of time it will take a car to reach a new hall call; and predicted waiting time (PWT), which is the sum of RRT and the amount of time that has already passed since the call was registered. In some cases, these values may be combined via two-dimensional fuzzy logic, to give an assignment value which is then combined (perhaps with fuzzy logic) with other dispatching considerations.

It has long been known that the tendency for elevator cars to become "bunched" detracts from good elevator service and results in unusually long waits for some calls. Elevator cars may be considered "bunched" when most of the cars in the group are in close physical proximity to each other, taking into account the direction of travel. Traditional anti-bunching techniques are based on the distance between each car and the car directions.

DISCLOSURE OF INVENTION

Objects of the invention include: automatic elevator dispatching which tends to minimize the average wait time; dispatching which reduces long wait times; dispatching which provides satisfactory average wait times while at the same time avoiding either numerous long waits, or a few very long waits, for calls to be answered; dispatching which avoids bunching; and improved elevator dispatching which minimizes long waits and eliminates very long waits.

The invention is predicated on the concept that system performance (smooth flow of passenger traffic) and customer wait times are measured in time, whereas traditional bunching measures take into account only the physical distance that must be traversed.

According to the present invention, the time required to respond to calls in a building is used to evaluate the degree of bunching, and that evaluation is incorporated into the dispatching methodology. According to the invention, a metric that measures how well or how poorly elevator cars are distributed throughout the building, in terms of how they are positioned to answer potential calls in a satisfactory amount of time, is used to evaluate the response time potential with respect to car locations and existing demand. In one embodiment of the invention, the metric evaluates how many potential calls could be answered within 30 seconds, which is deemed satisfactory performance, within 30–45 seconds, which is deemed slightly unsatisfactory performance, within 45 to 60 seconds, which is deemed moderately unsatisfactory performance, within 60–90 seconds, which is deemed unsatisfactory performance, and in over 90 seconds, which is deemed very unsatisfactory performance. In this embodiment, the counts are combined using fuzzy logic, although other methods, such as weighted averages or weighted penalties may be used to combine the counts of the metric. Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 3 is a chart illustrating the determination of times for car A in the example of FIG. 2 using the routine of FIG. 1.

FIG. 4 is a chart illustrating the determination of times for car B in the example of FIG. 2 using the routine of FIG. 1.

FIG. 5 is a chart illustrating the minimum results of FIGS. 3 and 4.

FIG. 6 is a chart illustrating minimum times, and number of floors (count) in each category.

MODE(S) FOR CARRYING OUT THE INVENTION

Figure 1:
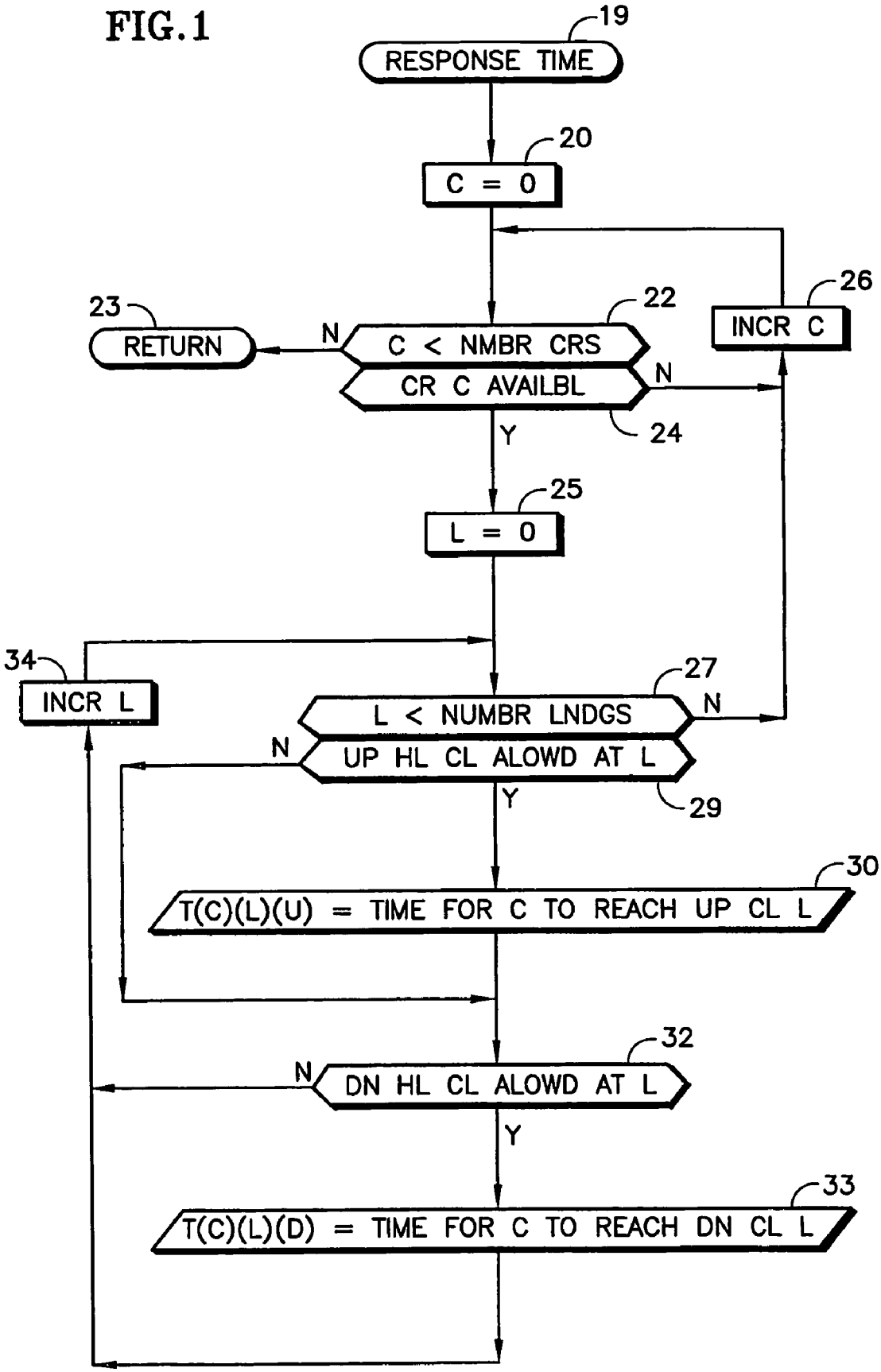
FIG. 1 is a logic flow diagram of a routine for determining the time for each car to reach each call at a landing.

Referring to FIG. 1, a response time routine is reached through an entry point 19 and a first step 20 sets a value C, which identifies the various cars, equal to zero. Step 20 causes car zero to be designated. A test 22 determines if all of the cars have been tested, in which case the value of C would not be less than the known number of cars. When all of the cars have been tested, the program will revert to other processing through a return point 23.

Initially, all the cars have not been tested, so an affirmative result of test 22 reaches a test 24 to determine if car C is available to respond to requests for service (demand). If not, a negative result of test 24 reaches a step 26 to increment C, thereby pointing to the next car in turn. If car C is available, an affirmative result of test 24 reaches a step 25 to set a factor, L, equal to zero. This factor identifies the landing in the building, so step 25 identifies, for instance, the lowest floor in the building. A test 27 determines if L is less than the known number of landings, meaning all the floors have been tested with respect to a particular car. Initially, L will be less than the number of landings so an affirmative result of test 27 reaches a test 29 to determine if an up hall call is allowed at landing L. Such will be the case for all except the highest landing in the building. An affirmative result of test 29 reaches a subroutine 30 that determines the time for car C to reach an up call at landing L. This is a conventional determination which takes into account the location of the car, the state of the car (running or not), the state of the door (open, opening, closed or closing, in some embodiments) and the hall calls assigned to the car as well as car calls already registered in the car. A different amount of time is assessed for each of those conditions, and the total is an estimation of how long it will take for this car to reach that landing. If the upper floor is being tested, a negative result of test 29 will cause the routine to bypass the subroutine 30.

Then a test 32 determines if a down hall call is allowed at this landing. If so, a subroutine 33 determines the time it will take for car C to reach a down call at landing L. The same factors are used in this subroutine as are used in the subroutine 30. If a down call is not allowed at floor L (which is true for the lowest floor in the building) then a negative result of test 32 will bypass the subroutine 33.

Then the routine reaches a step 34 to increment L thereby designating the next floor in turn. Then the steps and tests 26–33 are repeated for the next landing. This continues until determination of the time for this car to reach all of the landings have been made, in which case test 27 will be negative, reaching step 26 to designate the next car in turn. Unless all of the cars have been tested, test 22 will again be affirmative reaching test 24 to see if this car is available. If so, step 25 will designate the lowest landing in the building again, so that all of the landings may be considered to determine the time it will take for this second car to reach up calls and down calls at the landings.

When all of the cars have been tested with respect to all of the floors, test 22 is negative causing the routine to revert to other programming through the return point 23.

Figure 2:
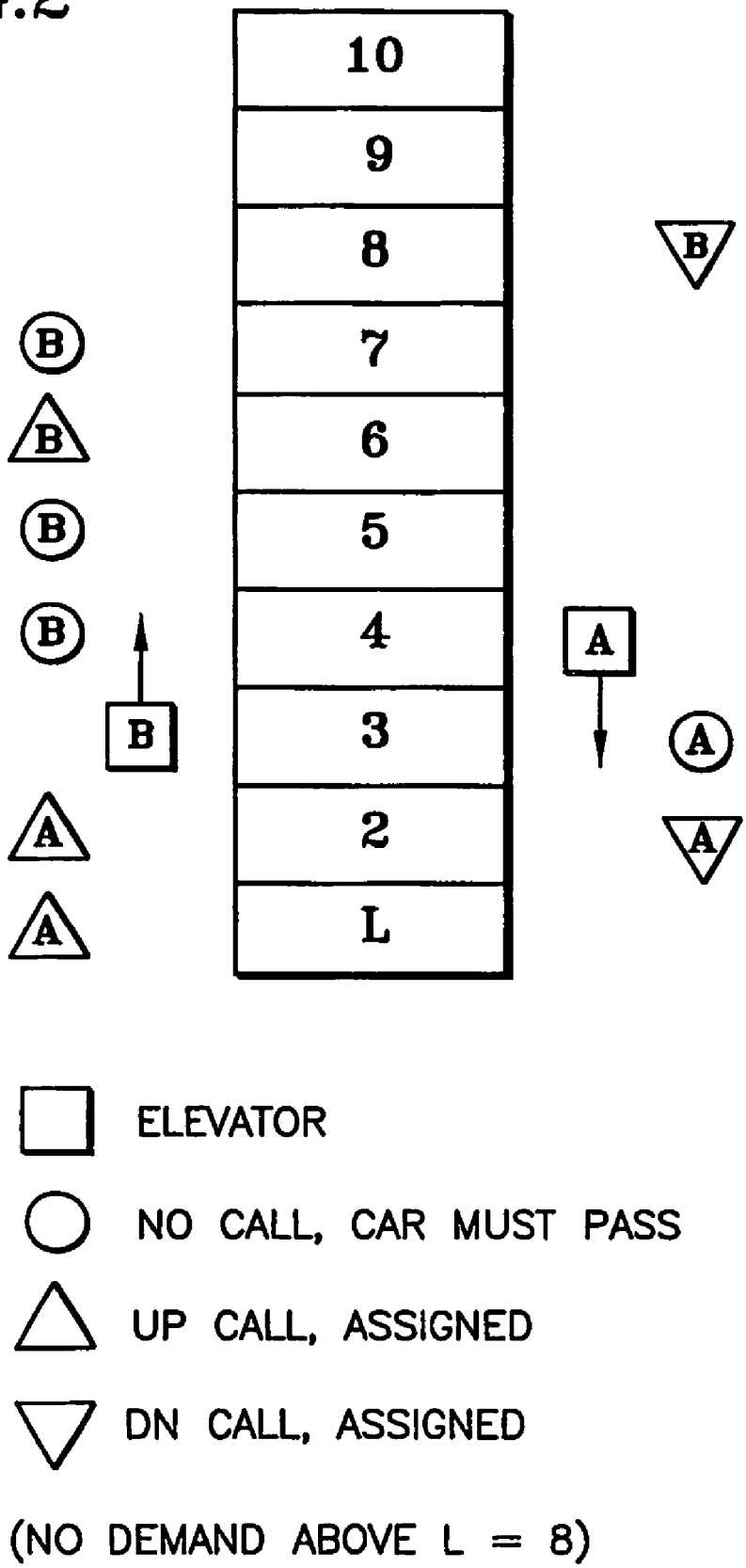
FIG. 2 is a stylized depiction of a two elevator, ten landing example.
Figure 7:
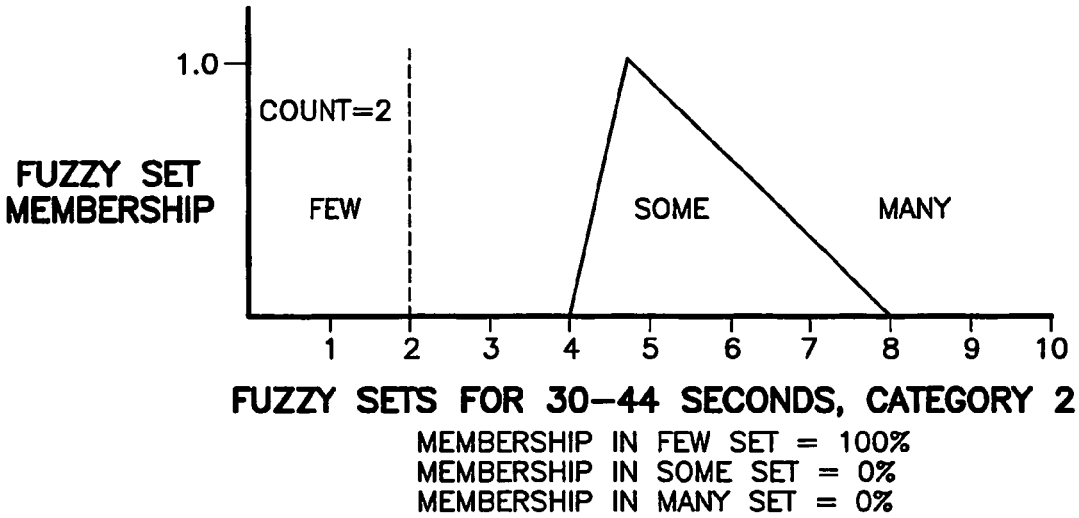
FIGS. 7–10 are diagrams of fuzzy sets for categories 2–5, respectively.

FIG. 2 illustrates an example of a 10 landing building with car A traveling down at the fourth landing and car B traveling up at the third landing. Car B has been assigned to an up call at landing 6 and a down call at landing 8. Car B must pass landings 4, 5 and 7 without stopping in order to reach the call at landing 8. Car A has a down call at landing 2 and up calls at the lobby and landing 2. Car A must pass landing 3 without stopping in order to reach these assigned calls.

As an exemplary embodiment, it is assumed that the subroutines 30, 33 in FIG. 1 utilize an algorithm in which passing a floor takes one second, a car call takes ten seconds and a hall call takes 11 seconds, whether or not there is a coincident car call. Of course, other factors may be utilized, and other numbers may be utilized, in any implementation of the present invention.

In FIGS. 3 and 4 the time to reach each floor is calculated for car A and car B, respectively. In FIG. 5, for each floor, the amount of time it is estimated that it will take for car A and for car B to reach that floor from their present position is listed, and the minimum of the two is listed in a fourth column.

In FIG. 6, categories of ranges of time to reach the floors are set forth, the lowest category being category 1 in which calls requiring between 0 and 29 seconds are counted. This category is not utilized in the fuzzy logic processing to be described hereinafter, in this example, because the time is too short to be of significance. However, in other embodiments, as desired, category 1 may also be taken into account. Categories 2 through 5 represent 30–44, 45–59, 60–89, and over 90 seconds as shown in FIG. 6. FIG. 6 in the third column shows how many landings are in each category, as determined by the fifth column of FIG. 5.

Figure 8:
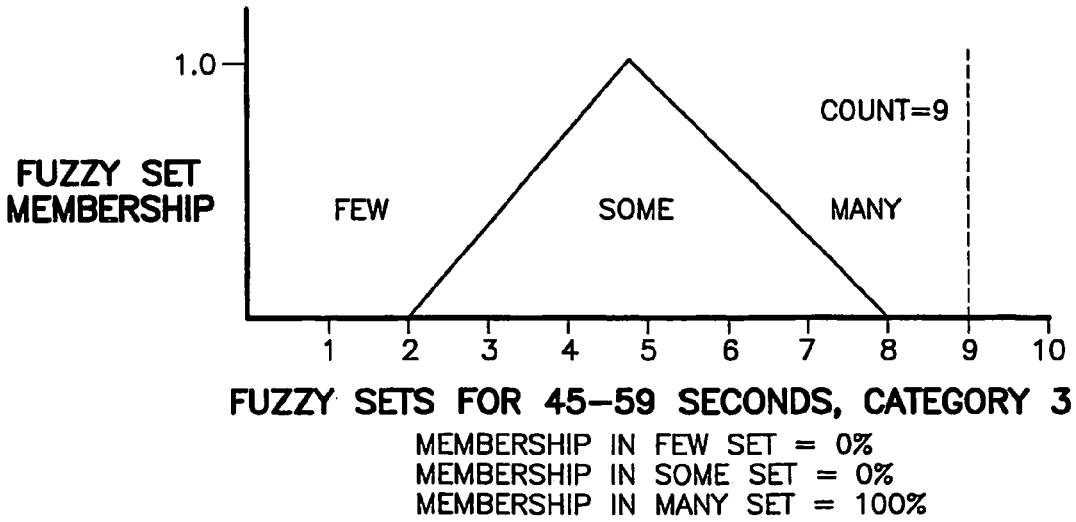
Figure 9:
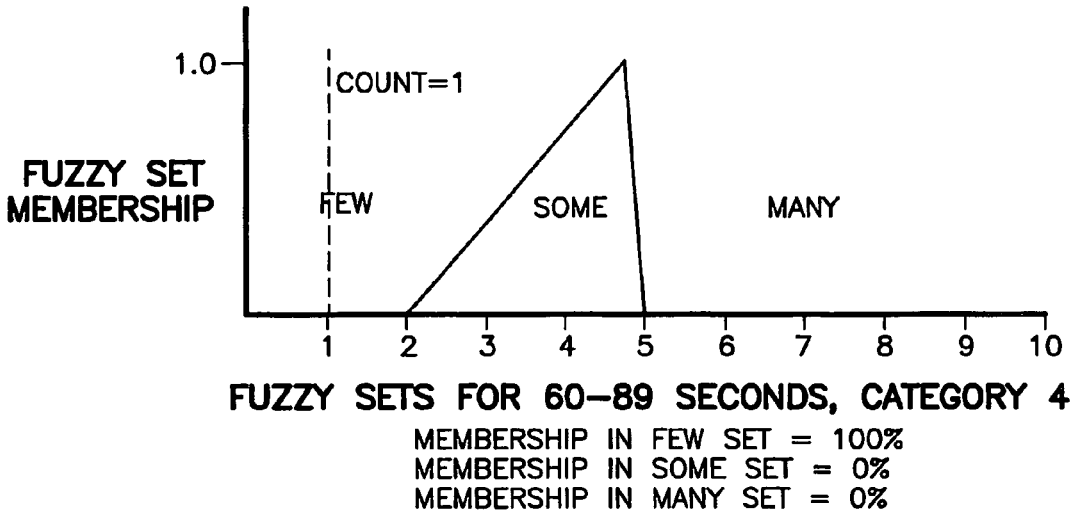
Figure 10:
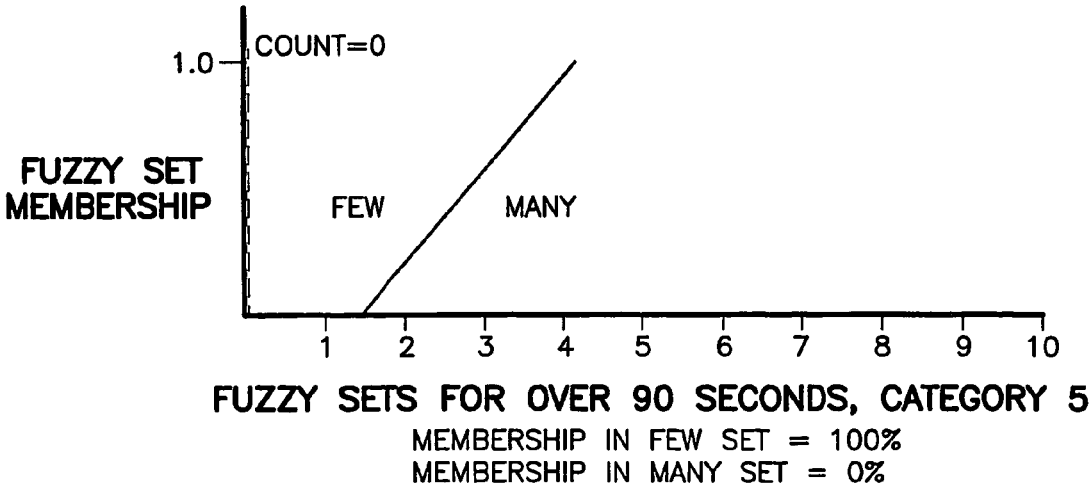

The counts of FIG. 6 are then applied to the corresponding fuzzy sets in FIGS. 7–10. For instance, category 2 is set forth in FIG. 7 and since only two landings fall within the range of 30–44 seconds, this results in a fuzzy set membership of 1.0, and a designation of few. In FIG. 8, category 3 has a count of 9 landings, which results in a fuzzy set membership of 1.0 and a designation of many. In FIG. 9, category 4 has a count of only one landing, resulting in a fuzzy set membership of 1.0 and a designation of few. In FIG. 10, category 5 has a count of zero resulting in a fuzzy set membership of 1.0 and a designation of few.

The fuzzy separation metric is calculated according to the following steps. Membership combinations are calculated by finding all possible combinations of fuzzy set memberships and then multiplying the value of each membership in the combination. There are 54 possible combinations based on the fuzzy sets and fuzzy set relationship table described in FIGS. 7–11:

Possibilities for 30–44 Seconds, Category (FEW, SOME, MANY)=3

Possibilities for 45–59 Seconds, Category (FEW, SOME, MANY)=3

Possibilities for 60–89 Seconds, Category (FEW, SOME, MANY)=3

Possibilities for Over 90 Seconds, Category (FEW, MANY)=2

3×3×3×2=54 Combinations.

The only combinations that matter to the fuzzy calculation are the non-zero memberships, and in the example documented, the non-zero memberships are all 100%=1, in categories 2–5 (fuzzy AND is multiplication):

Category 2, Membership (30–44 Seconds, FEW)=100% AND Category 3, Membership (45–59 Seconds, MANY)=100% AND Category 4, Membership (60–89 Seconds, FEW)=100% AND Category 5, Membership (Over 90 Seconds, FEW)=100%

100%×100%×100%×100%=100% (1×1×1×1=1)

Figure 11:
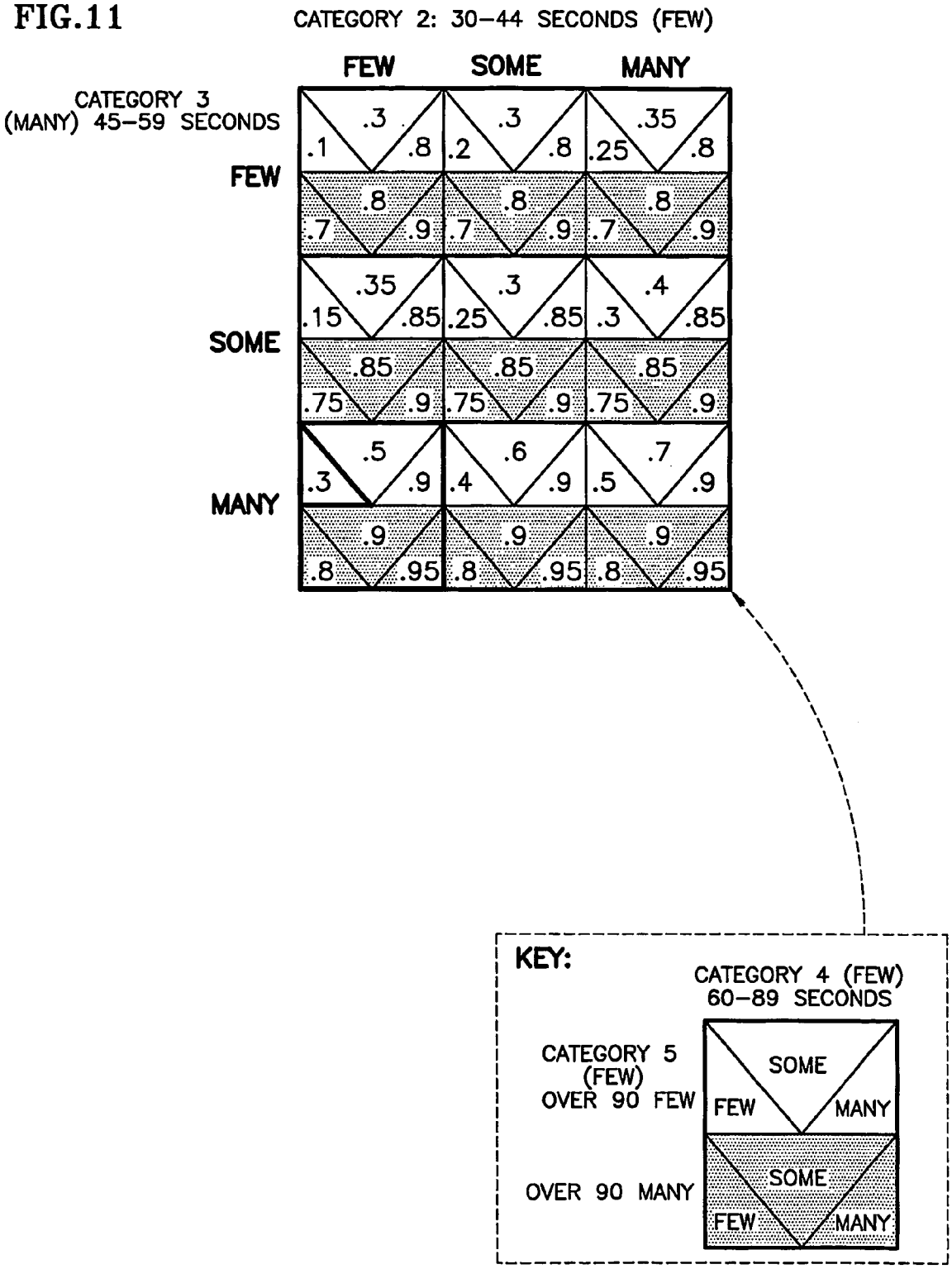
FIG. 11 is a stylized depiction of a 3×3×3×2 matrix of fuzzy sets which combine categories 2–5.

Referring to FIG. 11, a 3×3×3×2 fuzzy matrix is illustrated. The numbers therein are selected for this embodiment, but those numbers may be altered so as to better reflect any actual implementation of the present invention. Beginning with category 2, since its fuzzy designation is few (FIG. 7), the first column of the top portion of FIG. 11 is selected. Then, for category 3, since in FIG. 8 the fuzzy designation is MANY, the bottom row is selected. Then, referring to the key at the bottom of FIG. 11, for category 4, the number is FEW so that only the two left triangles are involved, and since category 5 is also FEW, only the upper left triangle is involved. This is shown in the upper part of FIG. 11 as resulting in a relationship value of 0.3.

Thus, for the example scenario, the separation metric of the invention is 0.3 for the example of FIG. 2, using values shown in FIGS. 3 and 4, the fuzzy sets of FIGS. 7–10, and the relationship of FIG. 11. The separation matrix of the invention may be used in a variety of ways. Typically, modern dispatching algorithms may utilize a variety of parameters to determine how a new hall call is to be assigned, without negatively impacting other passengers in the system. One consideration is remaining response time (RRT) which is the predicted amount of time it will take a car to reach a new hall call as is disclosed in U.S. Pat. No. 5,274,202. Another predicted waiting time (PWT), which adds to RRT the amount of time that has already passed since the call was registered, may be used. These values may be combined via a two-dimensional fuzzy logic, in typical present day call assignment algorithms. These may then be combined with other dispatching considerations such as relative system response (RSR) as is disclosed in U.S. Pat. No. 4,815,568. Relative system response and remaining response time values which may be calculated for hall calls can be combined in a fashion disclosed in U.S. Pat. No. 5,146,053.

The separation metric of the present invention can be combined with other metrics such as remaining response time, predicted waiting time, relative system response, by appropriate three- or four-dimensional fuzzy logic with the three or more dimensions correlated to RRT, PWT and RSR memberships, and the time based separation membership of the present invention. An assignment value which has been so calculated is used in the same way that any of the prior art two-or-three-dimensional assignment values are used.

The invention will improve overall system performance by reducing bunching as compared with no anti-bunching technique or the existing distance-based bunching technique. The separation matrix of the invention may be utilized in other fashions to suit any needs in any implementation thereof.

The invention claimed is:

1. A method of determining a separation matrix for each of a plurality of elevator cars serving a plurality of landings in a building, comprising:

(a) for each hall call in either the up direction or the down direction which is registered at any of the landings, determining (30, 33) the amount of time that it is predicted to take in order for each car to arrive at that landing taking into account the car position, the direction of car travel, the hall calls assigned to the car and the car calls registered in the car;

characterized by:

(b) organizing the times determined in step (a) in a sequence of categories (FIG. 3, FIG. 4) of ranges of time for each car, all but the highest of said categories in said sequences representing a lesser range of time than the category next higher thereto in said sequences, all but the lowest of said categories in said sequences representing a higher range of time than the category next lower thereto in said sequences;

(c) at least some of said categories being provided with corresponding fuzzy set complexes (FIGS. 7–10) including at least two sets selected from FEW, SOME, and MANY;

(d) determining, for each of said categories, the membership in said corresponding fuzzy set;

(e) providing a membership combination of the non-zero memberships of all of said fuzzy sets by fuzzy ANDing them together, which comprises multiplying them;

(f) providing a matrix of as many dimensions as there are categories and determining from the non-zero memberships, a relationship value indicated by said matrix; and (g) multiplying the membership combination value by the corresponding relationship value to determine the separation metric.

2. A method of assigning hall calls to selected ones of a plurality of cars serving a plurality of landings in a building, comprising:

(h) determining a separation matrix for each car according to the method of claim 1; and (i) combining (FIG. 11) said separation matrix with other dispatching in a two-or-three-dimensional fuzzy set; and (j) assigning cars to calls in accordance with the result of step (i).

* * * * *